US006599864B1

(12) United States Patent
Bertomeu

(10) Patent No.: US 6,599,864 B1
(45) Date of Patent: Jul. 29, 2003

(54) HYDROCARBON BASE OIL FOR LUBRICANTS WITH VERY HIGH VISCOSITY INDEX

(75) Inventor: Olivier Bertomeu, Le Havre (FR)

(73) Assignee: Total Raffinage Distribution S.A., Puteaux (FR)

( * ) Notice: Subject to any disclaimer, the term of this patent is extended or adjusted under 35 U.S.C. 154(b) by 0 days.

(21) Appl. No.: 10/070,380

(22) PCT Filed: Sep. 7, 2000

(86) PCT No.: PCT/FR00/02463

§ 371 (c)(1),
(2), (4) Date: Jun. 19, 2002

(87) PCT Pub. No.: WO01/18156

PCT Pub. Date: Mar. 15, 2001

(30) Foreign Application Priority Data

Sep. 8, 1999 (FR) ..... 99 11219

(51) Int. Cl.[7] ..... C10M 101/02; C10G 71/00
(52) U.S. Cl. ..... 508/110; 208/18; 585/13
(58) Field of Search ..... 508/110; 208/18; 585/13

(56) References Cited

U.S. PATENT DOCUMENTS 5,911,874 A * 6/1999 Cody et al. ..... 208/87
5,993,644 A * 11/1999 Xiao et al. ..... 208/89
6,059,955 A * 5/2000 Cody et al. ..... 208/18
6,096,189 A * 8/2000 Cody et al. ..... 208/87
6,245,719 B1 * 6/2001 Kobori ..... 508/110
6,246,826 B1 * 6/2001 O'Keefe et al. ..... 385/140
6,322,692 B1 * 11/2001 Cody et al. ..... 208/18
6,507,297 B2 * 1/2003 Perez et al. ..... 341/139

* cited by examiner

*Primary Examiner*—Jacqueline V. Howard
(74) *Attorney, Agent, or Firm*—Sughrue Mion, PLLC

(57) ABSTRACT

The invention concerns a novel hydrocarbon base oil for lubricants, having a viscosity index not less than 130, comprising mainly long isoparaffinic hydrocarbon chains, branched over several carbon atoms. The invention is characterized in that said chains comprise a number of carbon atoms greater than 25 and have a ratio of the number of substituents consisting of at least two carbon atoms over the number of methyl-type substituents, not less than 0.9.

13 Claims, No Drawings

HYDROCARBON BASE OIL FOR LUBRICANTS WITH VERY HIGH VISCOSITY INDEX

This application is a 371 of PCT/FR00/02463 Sep. 7, 2000.

The invention relates to a novel hydrocarbon base oil for high end lubricants, obtained from hydrocarbon cuts of various provenances. More precisely, the invention relates to an oil of this type, with a viscosity index VI, calculated according to the French standard NF T 60-136, greater than 130, for a kinematic viscosity measured at 100° C. (Vk@100° C.), measured according to the NF standard T 60-100, ranging between 3.5 and 4.5 $mm^2/s$ (or cSt). This novel base oil has a preferred application in the formulations of lubricants for engines, in particular in the automobile industry, as well as for industrial use.

The base oils are currently classed in five groups according to the API classification, based on characteristics defined in Table I hereafter:

TABLE I

| | Saturated compounds (% by weight) | Sulfur content (% by weight) | Viscosity Index VI |
|---|---|---|---|
| Group I | <90 | >0.03 | 80 < VI < 120 |
| Group II | >90 | <0.03 | 80 < VI < 120 |
| Group III | >90 | <0.03 | >120 |
| Group IV | | PAO (Poly-alpha olefins) | |
| Group V | | Other (esters) | |

For a long time, Group 1 base oils for lubricants have been produced from certain distillate cuts obtained through distillation under vacuum of paraffin base crude oils since it is the high isoparaffin content of said crude oils that gives them good VI values. These distillates undergo a solvent extraction, resulting in a raffinate rich in paraffins and an extract rich in aromatics; the raffinate is then dewaxed by mixing it with an organic solvent (for example, methyl ethyl ketone or MEK), it is cooled and filtrated in order to obtain, through separation, solid paraffins or slack wax (elimination of the n-paraffins) and an oil with a VI of at least 95 and good properties when cold (pour point); lastly this oil undergoes a hydrofinishing to stabilize it and improve its color.

We remind you that the calculation of the viscosity index or VI of the oil products is done from their kinematic viscosities at 40° C. and at 100° C., according to the NF standard T 60-136.

However, for several years, stricter and stricter operating conditions for automobile engines have lead to more limiting specifications for base oils from which are formulated the engine oils, in particular a decrease in their volatility and a lower pour point and an increase of their VI (above 105). Yet such characteristics cannot be obtained solely by means of a solvent extraction of the distillation cuts ("straight run"), hence the development of oil production processes from other cuts, such as those resulting from catalytic hydrocracking and/or catalytic hydrodewaxing. Indeed, the saturation of the aromatic compounds and the decyclization of the naphthenes mainly take place during the hydrocracking reaction of the hydrocarbon charges, whereas the hydrodewaxing reaction causes the cracking and isomerization of the n-paraffins and improves the cold properties of the lubricating bases obtained.

Such bases, obtained from hydrocracking residues subjected to a solvent dewaxing, and belonging to group III according to the above-described API classification, are currently generated, in particular by the applicant, under the name NHC5 ("Neutral HydroCracked") with a Vk@100° C. of 4.5 to 5 $mm^2/s$ (4.5 to 5 cSt).

The man of the art already knows he can produce lubricant base oils with a high viscosity index (VI), for example greater than 125, from hydrocarbon charges originating from the heavy cuts or residues of a hydrocracker. The French patent application 2 194 767 A describes, in particular a method for preparing a lubricant oil with a high VI, comprising a catalytic hydrocracking treatment of a mineral oil cut with a high boiling point, a fractionation of the effluents, a dewaxing of the boiling residue above 350° C. and a catalytic hydroisomerization of the paraffin obtained.

The association of hydrocracking and isomerization phases with specific catalysts, for the manufacture of lubricants with a high VI is also described in EP 0 574 191 A and EP 0 597 935 A. This is also the case in EP 0 744 452 A that describes a method for producing such base oils, including a hydrocracking phase with a platinum and/or palladium base catalyst of a hydrocracking bottom cut so as to convert at least 25% by weight of the hydrocarbon cut with a boiling point of at least 370° C., followed by an effluent fractionation phase, where the heavy cut has a VI of at least 125 and preferably greater than 135, with a kinematic viscosity at 100° C. of at least 3.5 $mm^2/s$ or cSt, where the heavy cut is then subjected to a dewaxing phase. However, these patents or published applications do not give any details as to the cold properties of the lubricant bases obtained, such as their pour point, or their structure.

Another known way to obtain base oils with a high VI is from very high paraffin-base hydrocarbon charges, in particular consisting of n-paraffin or wax compounds obtained via Fischer-Tropsch synthesis or of slack wax. This is how EP 0 323 092 A describes a method for producing oil with a high VI, comprising hydrotreatment, catalytic hydroisomerization and dewaxing phases, and WO 97/21788 A describes a method for producing a biodegradable lubricating base oil that includes hydroisomerization and catalytic hydrocracking of a cut with a boiling point that is greater than 370° C. of a Fischer-Tropsch paraffin charge, fractionation of the effluent obtained, whose heavy cut contains paraffins branched by methyl radicals, and lastly solvent dewaxing. Although this last application describes a rate of ramification per molecule that ranges between 6 and 7.5 methyl groups for 100 carbon atoms, it is stated that there are very few ramifications by groups with 2 or more carbon atoms (ethyl).

Yet surprisingly, the applicant has established that the quality of these oils is linked to the isoparaffinic nature of the hydrocarbon chains of the cuts used and, in particular, has a specific relation between the different types of substitutes carried by said chains.

Therefore, the object of this invention is to obtain a novel base oil for high end lubricants, obtained from hydrocarbon cuts of various provenances, with a high viscosity index and improved cold properties, in particular a pour point of less than −18° C., guaranteeing theological properties that are satisfactory for the finished lubricating oils formulated from this base oil, in a wide range of temperatures (from −30 to +100° C.), thanks to a specific ramification structure of the paraffin base molecules of which it consists.

We noted in particular that the base oil as set forth in the invention has a much better performance than the bases currently available on the market, resulting from hydrocracked products and having undergone a solvent dewaxing (NHC5 type oils), or a catalytic dewaxing, and that belong to group III based on the API classification described above. Surprisingly, it can also replace known synthetic bases such as the poly-alpha olefins (PAO), that belong to group IV, whose performances are well known for increasing the VI, but that have the major disadvantage of costing much more than the bases of mineral origin.

With this in mind, the object of the invention is a novel hydrocarbon base oil for lubricants, with a viscosity index or VI greater than or equal to 130, comprising mainly long, isoparaffin base, hydrocarbon chains, branched over several carbon atoms, characterized in that said chains comprise a number of carbon atoms greater than 25 and have a ratio of the number of substitutes consisting of at least two carbon atoms over the number of methyl type substitutes, greater than or equal to 0.9.

Indeed, it has been established that when the value of this ratio, for a base oil, is less than 0.9, the characteristics of the finished lubricating oils obtained from this base don't perform as well.

Preferably, said hydrocarbon chains have a ratio of the number of substitutes comprised of at least two carbon atoms, over the number of long chain $CH_2$, expressed in %, greater than or equal to 23%.

In particular, the base oil as set forth in the invention has a ratio of the viscosity index when cold (VIF) over the viscosity index (VI) (measured according to the NF standard T 60-136) greater than or equal to 1.

Advantageously, the base oil has a naphthenic molecule content that is less than or equal to 10%.

In particular, the base oil has a Noack volatility value of less than 13% by weight (calculated according to the standard CEC-L-40-A 95) as well as a pour point (calculated according to the NF standard T 60-105) of less than −18° C. Furthermore, it has a Saybolt color value of +30 (measured according to the ASTM method D 156).

Furthermore, the base oil has a cold viscosity index (VIF) greater than 125.

More particularly, the base oil has a dynamic viscosity CCS at −30° C. of less than 1200 mPa.s (calculated according to the ASTM standard D 5293) for a kinematic viscosity Vk at 100° C. of 4 $mm^2/s$.

In particular, the base oil as set forth in the invention has a viscosity index VI that is greater than 130 and less than or equal to 135, for a kinematic viscosity Vk at 100° C. ranging between 3.5 and 4.5 $mm^2/s$ or cSt.

More precisely, this base oil has a viscosity index VI that is greater than 135 for a kinematic viscosity Vk at 100° C. that ranges between 4.5 and 5 $mm^2/s$.

A second object of this invention relates to the use of the base oil as defined above, in the formulation of lubricants for engines, in particular for automobiles, namely with the intent to formulate an OW30 grade.

A third object of the invention relates to a method for preparing base oil as set forth in the invention consisting successively of hydrotreatment, hydrodewaxing, fractionation, and hydrofinishing phases of cuts of residues resulting from hydrocracking.

It has been shown that the novel base oil, as set forth in the invention, has interesting properties when cold, characterized, on the one hand, by a pour point that is less than −18° C. and on the other hand, by a new index called viscosity when cold (VIF) such that the oil has a ratio of cold viscosity index (VIF)/viscosity index (VI) that is greater than or equal to 1. The cold viscosity index VIF is calculated by using the usual formula for calculating the VI (according to the NF standard T 60-135), that includes the kinematic viscosity values at 100° C. and at 40° C. of the product to be measured, but replaces the kinematic viscosity value at 40° C. with the kinematic viscosity value at −30° C. The latter is obtained by dividing the dynamic viscosity at −30° C. (which is measurable) by the density of the product at −30° C., calculated from the density at 15° C., by correcting the temperature.

Different methods of analysis have been put in place to analyze the base oil as set forth in the invention (base oil A) and the following competitive products:

- base oil B obtained from a hydrocracked and hydrodewaxed charge with a high paraffin base, for example slack wax,
- base oil C obtained from a hydrocracked and hydrodewaxed charge with less of a paraffin base,
- base oil D of the NHC5 type,
- base oil E of the 150N type (group 1).

All these oils have a kinematic viscosity Vk@100° C. that ranges between 4 and 5 $mm^2/s$ (4 and 5 cSt).

Mass spectrometry has made it possible to evaluate the naphthenic molecules content of the various base oils: we find approximately 10% for oil A, as well as for oil B, versus 30% for oil C, 40% for oil D and 60% for oil E.

The RMN $^{13}C$ spectrums of these base oils were obtained using the following FULL method for preparing samples: 0.77 g of oil are incorporated into 1.5 ml of deuterated chloroform, to which are added 200 $\mu l$ of dioxane (0.23 g). The addition of dioxane (which gives one single fine crest at 67.2 ppm, outside the area of saturated carbons) in a constant quantity, makes possible an internal normalization of each spectrum and makes it possible to compare the height of the various spectrum crests to each other. The values that figure in Table 2 hereafter are crest heights expressed in cm, all normalized in relation to the crest of the dioxane at 100 cm, and can therefore be compared to each other.

A study of the RMN $^{13}C$ spectrums points out the following:

A) naphthenic carbons: their presence is not translated by fine crests, but by a continuous bottom in the area of the saturated carbons (65–5 ppm), not very visible from a qualitative point of view.

B) aromatic carbons: the content in aromatic carbons of these oils is low (less than 1%) and these do not give fine crests.

C) paraffin base carbons: the spectrum of these carbons is, in general, a spectrum with crests in the area of the saturated carbons (65–5 ppm). These crests correspond to paraffin base carbons in specific environments. Most of these crests are identified and attributed to known structures. In particular, we can distinguish:

- the "long chain $CH_2$" crest that is characteristic of $CH_2$ patterns located more than 3 carbon atoms away from one end of a chain or a substitution; we note (see Table 2 hereafter) that the height of this crest is clearly greater for the B base oil than for the other base oils, which is translated by the presence of pieces of straight chains without substitutions that are on average longer in this oil than in the others; the D oil and the A oil have lower values;
- the number of methyl substitutions per molecule, marked "Subst. C1", corresponds to the sum of the heights of four characteristic crests; the B oil has the highest value, followed by oil A and oil C;
- the number of longer substitutions per molecule, meaning of two carbon atoms and more (ethyl and more), marked "Subst. C2+" corresponds to the sum of three characteristic crests; we note that the A oil, as set forth in the invention, is clearly richer than the others in long substitutions.

Furthermore, if we calculate the ratio of the number of substitutions of 2 carbons and more over the number of methyl substitutions, we obtain the highest value for the A oil, 0.947, close to 1, which indicates a balanced mode of substitution, whereas, for the D, B and C oils, and even more so the E oil, the substitution ratio is more in favor of the methyl groups.

Also, the ratio of the number of substitutions of 2 carbons and more over the number of long chain $CH_2$ patterns, expressed in %, gives a value that is greater than 23% for the A oil, whereas it only reaches 21.8% for the C oil and approximately 14% for the B and D oils, with the E oil remaining below 3%. This characterizes, for the A oil as set forth in the invention, an n-paraffin base structure of concatenations shorter than those of a base from an origin very rich in paraffin, but replaced with a larger number of longer chains.

TABLE 2

| | Base oil A | Base oil B | Base oil C | Base oil D | Base oil E |
|---|---|---|---|---|---|
| Analysis of the RMN $^{13}C$ spectrums (height of crests in cm) long chain $CH_2$ crests | 59.34 | 87.03 | 50.22 | 76.14 | 42.49 |
| Subst. C1 crests. | 14.64 | 16.37 | 14.33 | 13.66 | 9.85 |
| Subst. C2+ Crests | 13.86 | 12.44 | 10.95 | 10.89 | 1.27 |
| Subst. C2+/ Subs. C1 Ratio | 0.947 | 0.760 | 0.764 | 0.797 | 0.129 |
| 100°SubstC2+/ long chain $CH_2$ ratio | 23.35 | 14.29 | 21.80 | 14.30 | 2.99 |
| % naphthenic molecules | 10 | 10 | 30 | 40 | 60 |
| VI | 131.4 | 142 | 126 | 128 | 100 |
| VIF | 135.7 | 112 | 123 | 113 | 50 |
| VIF/VI | 1.03 | 0.79 | 0.98 | 0.88 | 0.5 |

According to one preferred, but not restrictive, method of execution used to obtain the very good viscometric and pour properties when cold of the lubricating base oil as set forth in the invention, the applicant has implemented the following sequence of phases, from residues resulting from hydrocracking treatment with a boiling point that ranges between 300 and 600° C.:

(1) a first phase of hydrotreatment at a temperature ranging between 380 and 480° C., at a high pressure (8 MPa<$PH_2$<27 MPa), and a low hourly space velocity (0.15<VVH<1 $h^{-1}$), over a catalyst of the NiMO type, doped or not, on a support of the amorphous type. During this phase the decyclization of the naphthenes, the saturation of the aromatics and the cracking take place and lead to an improvement of the VI and a lowering of the kinematic viscosity;

(2) a second phase of catalytic dewaxing at high temperature (T ranging between approximately 300 and 400° C.), in the presence of a zeolitic type catalyst doped by noble metals such as platinum, during which the cracking and isomerization reactions of the n-paraffins take place. This phase makes it possible to improve the cold properties of the cut being treated, in particular lowering its pour point, while preserving the VI value;

(3) a third phase of fractionation under vacuum, to obtain cuts of approximately 400–470° C. (TBP), making it possible to adjust the kinematic viscosity Vk@100° C. to approximately 4 $mm^2/s$, and the Noack volatility under 13%.

(4) a last phase of hydrofinishing, at T<250° C., under a high pressure, ($PH_2$>10 Mpa), with a low hourly space velocity (0.3<VVH<0.8 $h^{-1}$) and with a Pt/Pd or Ni catalyst, making it possible to saturate the aromatic compounds (content <1000 ppm) to give the oil a slight coloration (Saybolt color value+30) and an oxidization stability.

However, other types of charges can advantageously be used, by mixing them with the previous charges, to dope them, in particular Fischer-Trepsch synthesis paraffins or waxes, waxes or slack waxes, and atmospheric distillation or vacuum distillates.

Furthermore, we can also consider obtaining the lubricant base oil as set forth in the invention, by oligomerization of olefins, in particular light alpha-olefins present in particular in the heavy gasoline of the viscosity breaking units or in the FCC gasoline (catalytic cracker). This oligomerization is done in the presence of a catalyst of the phosphoric acid or aluminum chloride type, at temperatures ranging between approximately 190° C. and 340° C. and leads to hydrocarbon products with highly branched long chains.

The base oils thus obtained, with a VI greater than 130 and a VIF greater than 125, can replace synthetic lubricant bases of the PAO type, with an interesting economic advantage, in formulations for oils for automobile engines and in particular in grades such as OW30, for which the cold properties requirements are the strictest; kinematic viscosity Vk@100° C. ranging between 9.3 and 12.5 $mm^2/s$ and dynamic viscosity CCS at −30° C. less than 3250 mPa.s.

The applicant has thus formulated an OW30 grade engine oil with a composition in % of weight:

| | |
|---|---|
| base oil A: | 80.1 |
| performance additive: | 13.8 |
| VI improvement additive: | 5.8 |
| additive to reduce the pour point: | 0.3 |
| This oil has the following characteristics: | |
| kinematic viscosity Vk@100° C. | 9.65 $mm^2/s$ |
| kinematic viscosity at 40° C. | 50.8 $mm^2/s$ |
| VI: | 178 |
| dynamic viscosity CCS at −30° C. | 3000 mPa.s. |

and it thus meets the specifications for this grade, as a replacement for a base oil of the PAO type or PAO and ester mix type. Furthermore, such a formulation meets in particular the TU3MH engine test criteria (according to the standard CEC-L-55-T-95).

These bases can also find interesting applications in formulations for industrial lubricants.

What is claimed is:

1. Novel hydrocarbon base oil for lubricants, with a viscosity index (VI) that is greater than or equal to 130, comprising mainly long, isoparaffin base branched hydrocarbon chains comprising a number of carbon atoms that is greater than 25 and branched over several carbon atoms, characterized in that said hydrocarbon chains have a ratio of the number of substitutes comprised of at least two carbon atoms over the number of methyl substitutes that is greater than or equal to 0.9 and in that said chains have a ratio of the number of substitutes comprised of at least two carbon atoms over the number of long chain $CH_2$ groups that is greater than or equal to 0.23.

2. Base oil as set forth in claim 1, characterized in that it has a ratio of the cold viscosity index (VIF) over the viscosity index (VI) that is greater than or equal to 1.

3. Base oil as set forth in claim 1, characterized in that it has a naphthenic molecule content that is less than or equal to 0.1.

4. Base oil as set forth in claim 1, characterized in that it has a Noack volatility value that is less than 13% by weight.

5. Base oil as set forth in claim 1, characterized in that it has a pour point that is less than −18° C.

6. Base oil as set forth in claim 1, characterized in that it has a Saybolt color value of +30.

7. Base oil as set forth in claim 2, characterized in that it has a cold viscosity index (VIF) that is greater than 125.

8. Base oil as set forth in claim 1, characterized in that it has a dynamic viscosity at −30° C. that is less than 1200 mPa.s, for a kinematic viscosity Vk at 100° C. of 4 $mm^2/s$.

9. Base oil as set forth in claim 1, characterized in that it has a viscosity index (VI) that ranges between 130 and 135 for a kinematic viscosity Vk at 100° C. that ranges between 3.5 and 4.5 $mm^2/s$.

10. Base oil as set forth in claim 1, characterized in that it has a viscosity index VI that is greater than 135 for a kinematic viscosity Vk at 100° C. that ranges between 4.5 and 5 $mm^{2/}s$.

11. Method for obtaining a base oil as set forth in claim 1, characterized in that it comprises the following successive phases:

a) a first hydrotreatment phase at a temperature ranging between 380 and 480° C., under high pressure (8 MPa<$PH_2$<27 MPa), and a low hourly space velocity (0.15<VVH<1 $h^{-1}$) over a Ni—Mo type catalyst, doped or not, on a support of the amorphous type.

b) a second catalytic dewaxing phase at a high temperature (T ranging between approximately 300 and 400° C.) in the presence of a zeolitic type catalyst doped by noble metals such as platinum.

c) a third fractionation phase under vacuum, to obtain cuts of approximately 400–470° C. (TBP)

d) a last phase of hydrofinishing, at T<250° C., under high pressure, ($PH_2$>10 Mpa), at a low hourly space velocity (0.3<VVH<0.8 $h^{-1}$) and with a Pt/Pd or Ni catalyst.

12. A lubricant for an engine, comprising a hydrocarbon base oil with a viscosity index or VI that is greater than or equal to 130, comprising mainly long, isoparaffin base, hydrocarbon chains, the hydrocarbon chains being branched over several carbon atoms, wherein said chains comprise a number of carbon atoms that is greater than 25 and have a ratio of the number of substitutes comprised of at least two carbon atoms over the number of substitutes of the methyl type that is greater than or equal to 0.9.

13. A lubricant as set forth in claim 12, wherein the engine is an automobile engine.

* * * * *